United States Patent [19]

Strasser

[11] Patent Number: 4,633,579

[45] Date of Patent: Jan. 6, 1987

[54] METHOD FOR MAKING A PRESSURE RESPONSIVE SWITCH

[75] Inventor: Werner Strasser, Lexington, Ky.

[73] Assignee: Texas Instruments Incorporated, Dallas, Tex.

[21] Appl. No.: 835,402

[22] Filed: Mar. 3, 1986

Related U.S. Application Data

[62] Division of Ser. No. 672,644, Nov. 19, 1984.

[51] Int. Cl.[4] ..... H01H 65/00

[52] U.S. Cl. ..... 29/622; 29/454; 228/173.6

[58] Field of Search ..... 29/622, 454; 228/173.6, 228/190; 200/83 R, 83 J, 83 P, 83 Y

[56] References Cited

U.S. PATENT DOCUMENTS

| | | | |
|---|---|---|---|
| 3,302,269 | 2/1967 | Cooper et al. | 29/622 |
| 3,335,242 | 8/1967 | Johnson | 200/83 P |
| 3,816,685 | 6/1974 | Fiore | 200/83 P |
| 4,121,073 | 10/1978 | Bileski et al. | 200/83 P |

*Primary Examiner*—Howard N. Goldberg
*Assistant Examiner*—P. W. Echols
*Attorney, Agent, or Firm*—John A. Haug; James P. McAndrews; Melvin Sharp

[57] ABSTRACT

A hermetically sealed, creep acting pressure switch has a sensor assembly comprising a bulged metallic membrane welded between a port fitting and a support. A switch assembly, attached to the sensor assembly, includes a housing which has a switch chamber in which, in one embodiment, a pair of stationary contacts are mounted. A piston having a force receiving surface at one end is biased into engagement with the membrane with an adjustable calibrated force. An electrically conductive contact bridge is mounted on and is movable with the piston. The switch can be normally open or normally closed depending on which side of the contact bridge the stationary contacts are mounted. In an alternate embodiment a miniature switch is mounted in the switch chamber and is adapted to be actuated by the piston.

1 Claim, 7 Drawing Figures

METHOD FOR MAKING A PRESSURE RESPONSIVE SWITCH

This application is a division of application Ser. No. 672,644, filed Nov. 19, 1984.

BACKGROUND OF THE INVENTION

This invention relates generally to pressure responsive electrical switches and more particularly to such switches which have little differential between actuation and deactuation pressures.

Pressure switches are used for many different applications to monitor pressure conditions and upon occurrence of predetermined changes in pressure to provide a signal of such change or to energize or deenergize some related function.

One type of switch, such as that shown and described in U.S. Pat. No. 4,296,287, has had wide acceptance and has been used for many applications utilizes a snap acting monometallic or multimetallic disc which is welded to a housing thereby enclosing a chamber which is in communication with a fluid medium whose pressure is to be monitored. A switch is mounted on the other side of the disc and comprises a motion transfer member slidably mounted adjacent the disc and extending between the disc and a movable contact arm. When a selected pressure condition occurs, the disc snaps from a first dished configuration to an opposite dished configuration concomitantly transferring motion through the motion transfer member to the movable contact arm to open or close an electric circuit. The disc is adapted to snap in one direction upon being subjected to a particular pressure level or higher and will snap back in the opposite direction to its original configuration when the pressure decreases to a second, lower pressure. This pressure differential is desirable for many applications but is undesirable for certain other applications.

For example, in monitoring the pressure of transmission fluid for off road construction vehicles little or no differential between the actuation pressure and the release pressure is preferred. In such applications a snap acting disc is unsuitable because it inherently has too much pressure differential.

Other known pressure responsive switches such as that shown in U.S. Pat. No. 4,342,887 have a pressure chamber mounted adjacent to a switch with a flexible organic membrane used to seal the chamber and transfer the pressure to the switch. Use of such material for a seal for the present application however is unsuitable because the expected seal life is too short. The present application for transmission fluid monitoring involves relatively high pressure, for example 135 psi, over several hundred of thousands of pressure cycles.

Yet another prior art switch is shown in U.S. Pat. No. 4,272,660 and comprises a switch assembly attached to a vacuum chamber closed by a metal diaphragm. The diaphragm is mounted on a toroidal projection to enable it to flex and transmit pressure to the switch. However the use of the projection tends to introduce stresses in the diaphragm which limits its useful life.

It is therefor an object of the present invention to provide a pressure switch having little or no differential between actuation and release pressure levels. Another object is the provision of a pressure sensor which is hermetically sealed, is resistant to various chemical fluids and has an improved product life. Yet another object is the provision of a pressure responsive switch which is adaptable to a broad range of pressure settings, can be easily adapted to different ranges of pressure and is easily adjustable for fine adjustments. Yet another object is the provision of a pressure switch which is insensitive to vibration, is suitable for use with positive as well as negative pressures, is reliable, long lasting and yet inexpensive.

Other objects, advantages and details of the pressure responsive device of this invention appear in the following detailed description of preferred embodiments of the invention.

BRIEF SUMMARY OF THE INVENTION

Briefly described, a pressure responsive device made in accordance with the invention comprises a sensor assembly having one or more layers of metallic membrane covering a recessed end of a relatively massive port fitting with an apertured support plate disposed beneath the membrane. The fitting, membrane and support plate are clamped together and a force is exerted on the membrane through the aperture in the support plate to form a smooth bulge in the membrane moving it against a stop surface comprising the back wall defining the recess. The fitting, bulged membrane and support are welded together all along their outer periphery to form a hermetic seal.

A piston having a force receiving surface is mounted in the housing attached to the fitting and support plate and is movable toward and away from the membrane. An electrically conductive bridge element is mounted on and is movable with the piston and is adapted to move into and out of engagement with a pair of stationary electrical contacts mounted in the switch chamber. A coil spring is received about the piston and extends from a spring seat formed on a hub disposed on the piston and a plug which is received in and closes an opening in the housing. The plug is movable to adjust the compression of the spring to calibrate the switch and can be locked in a selected adjusted position.

In an alternate embodiment a separate miniature switch is mounted in the housing and is adapted to be actuated by movement of the piston.

BRIEF DESCRIPTION OF THE DRAWING

In the following detailed description of preferred embodiments of the invention, the detailed description refers to the drawings in which.

DESCRIPTION OF PREFERRED EMBODIMENTS

Figure 1:
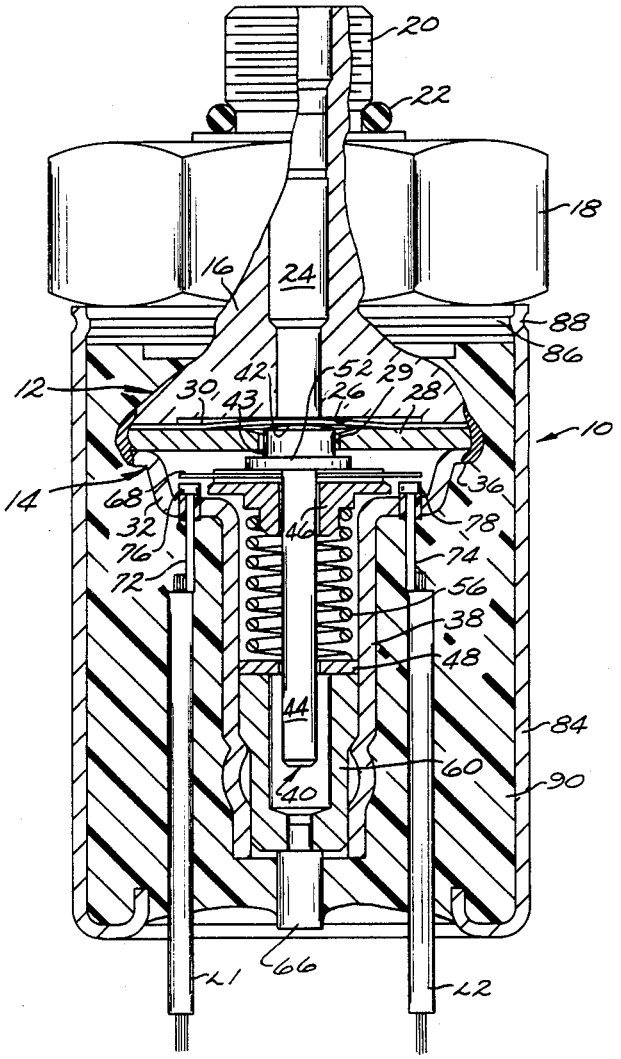
FIG. 1 is a partial sectional view taken along the longitudinal axis of the device provided by this invention.

Referring to the drawings numeral 10 represents a pressure responsive switch made in accordance with the invention which comprises a sensor assembly 12 and a switch assembly 14 attached thereto. Sensor assembly 12 includes a relatively massive fitting 16 of suitable material such as a nickel plated ASTM 12L14 steel which is preferably formed with a hexagonal outer body portion 18 to facilitate mounting of the device to a source of pressure via threaded coupling 20 which is hermetically attached to fitting 16 as by welding. An "O" ring 22 of conventional material may be provided to facilitate the seal between the device and the pressure source. Coupling 20 and fitting 16 are provided with a longitudinally extending bore 24 which leads to a lower end of the fitting. A bottom wall 26 is recessed slightly from the end of the fitting preferably approximately 15 mils to form a sensing chamber aproximately 0.55 inch in diameter and forms a stop surface for the membrane to be described below.

One or more layers of a metallic membrane 30, preferably stainless steel, is disposed between fitting 16 and support plate 28. Support plate 28, a generally washer shaped member having an outer diameter in the order of 0.8 inch for example is preferably formed of stainless steel such as AISI 304. The plate is bent into the shape of a cone with the inner portion of plate 28 forming aperture 29 being approximately 8 mils lower than the outer periphery as indicated by arrows "d" shown in FIG. 5. This, along with recessed portion 26, provide a total vertical deflection of approximately 23 mils for sensing membrane 30. Although shown in FIGS. 1 and 2 as a single layer in most applications it is preferred to use two layers of 4 or 5 mils each. As will be discussed in greater detail below a hermetic seal is effected among fitting 16, membrane 30 and support plate 28 as by welding all around their outer periphery.

A housing 32 preferably formed of stainless steel has an upper dished portion forming a switch chamber 34 and has an annular flange 36 which is attached to the sensor assembly 12 as by welding. An elongated tubular portion 38 extends downwardly from the upper dished portion and receives therein a movable contact assembly comprising a piston member 40 having at one end a force receiving surface 42 and a rod 44 extending along the longitudinal axis of the tubular portion 38. Upper piston surface 43 and bearing member 48 mount piston 40 for sliding movement along the longitudinal axis of tubular portion 38. A spring guide member 46 disposed on rod 44 is hub shaped having a radially extending flange 49 which extends over the bottom surface 50 of the dished portion of housing 32 limiting the downward movement of piston 40 through a flange 52 formed on the piston. A spring seat 54 is formed on hub guide member 46 with a coil spring 56 disposed about piston rod 44 from seat 54 to ring shaped bearing member 48.

Tubular portion 38 is formed with an open end which is closed by a hollowed out plug 60. Plug 60 is cylindrical and is preferably formed with a first small diameter portion at its lower end to be closely received in a reduced diameter lower portion 62 of housing 32 (see the right hand portion of FIG. 2). The upper portion of plug 60 has a larger diameter so that the outward movement of plug 60 is limited by the reduced diameter portion of housing 32. Plug 60 is also preferably formed with a bore 64 to permit reception of a pressure equalization member 66. Pressure equalization member 66 can be made as taught in U.S. Pat. No. 4,296,287 referenced supra and essentially comprises compressed powdered material sintered to allow pressure equalization in chamber 34 without entry of liquid or other contaminants.

Figure 3:
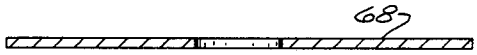
FIG. 3 is an enlarged sectional view of the electrically conductive bridge element depicted in FIGS. 1 and 2.

Disposed on piston rod 44 between flange 52 and spring guide member 46 is a washer shaped electrically conductive bridge element 68 (see FIG. 3) preferably formed of stainless steel material such as AISI 302 sandwiched between a pair of electrically insulating rings 70 formed of Kapton, a polyamide, or similar electrically insulative material. Element 68 serves as a relatively stiff spring to optimize electrical connection when in the contacts engaged position.

Housing 32 is formed with a pair of apertures to permit reception therethrough of terminals 72, 74 which mount on a respective end of each a stationary contact 76, 78. A sleeve 80 of Teflon, a tetrafluoroethylene polymer, or similar suitable electrical insulation is placed on terminals 72, 74 to electrically isolate them from housing 32.

The outer peripheral portion of bridge element 68 is therefor adapted to move into and out of engagement with stationary contacts 76, 78 to open or close a circuit extending between terminals 72, 74. As shown in FIG. 1, the bias of spring 56 moves piston 40 upwardly with force receiving surface 42 biasing membrane 30 into engagement with wall surface 26 thereby maintaining bridge element 68 out of engagement with stationary contacts 76, 78. This is a normally open switch which will close if pressures received in coupling 20 exceed the bias of spring 56.

Figure 2:
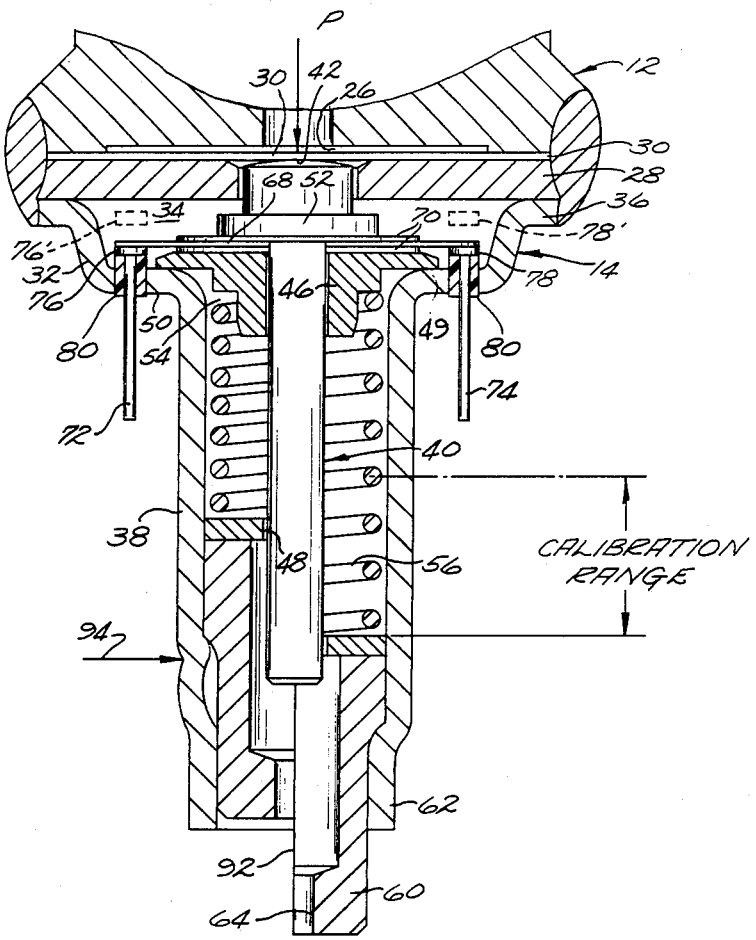
FIG. 2 is an enlarged sectional view of a portion of the FIG. 1 device showing on the right side of the longitudinal axis the device prior to calibration and on the left side of the longitudinal axis the device after calibration.

As seen in FIG. 2 in dashed lines, the stationary contacts 76', 78' can be disposed on the opposite side of the electrical bridge element with their respective leads entering chamber 34 through the side wall of housing 32 to provide a normally closed switch with spring 56 biasing contact bridge 68 into engagement with stationary contact elements 76', 78' at pressures below the calibrated pressure level. When the source pressures shown schematically in FIG. 2 by arrow P increases to the calibrated level and above, the membrane will move downwardly forcing piston 40 to move downwardly and thereby opening the circuit between terminals 72, 74.

It will be understood that, if desired, terminal 72, 74 can be brought into the switch chamber through the side wall of housing 32 for normally open contacts 76, 78 rather than the bottom wall as shown in the drawings. In this way slight movement of the terminal along their longitudinal axis would not change the spatial relationship between the stationary contact and the movable contact or bridge element.

Figure 4:
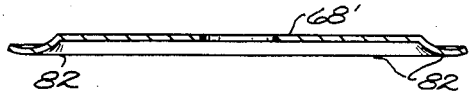
FIG. 4 is a view similar to FIG. 3 of an alternate bridge element useful in the FIGS. 1 and 2 device.

As seen in FIG. 4, bridge element 68' having a smoothly curved downwardly convex contact surface can be used if desired to provide higher contact pressures as well as to ensure that the contact surface is always located on a flat plane which coincides with a plane passing through the top surface of the stationary contacts as the piston moves to the contacts closed position.

Suitable lead wires L1 and L2 are attached to terminals 72, 74 in any suitable manner and a generally cylindrical skirt 84 is received over the welded portion of fitting 16 and extends down beyond the distal end of tubular portion 38. Fitting 16 is formed with an annular groove 86 which receives a deformed ring portion 88 formed in the upper end portion of skirt 84. Electrically insulative potting material such as a suitable epoxy 90 is infilled in the enclosure formed between assemblies 12 and 14 and skirt 84 with only leads L1 and L2 and a portion of member 66 projecting from the potting material.

Figure 5:
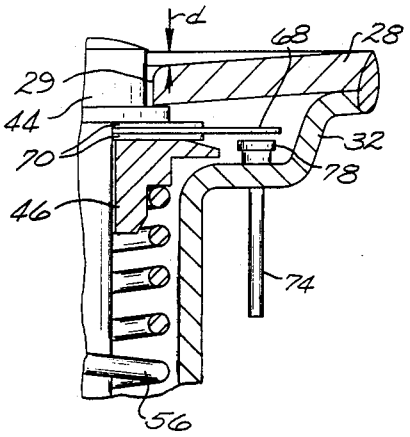
FIG. 5 is a cross sectional view of a portion of the sensor support and switch.
Figure 6:
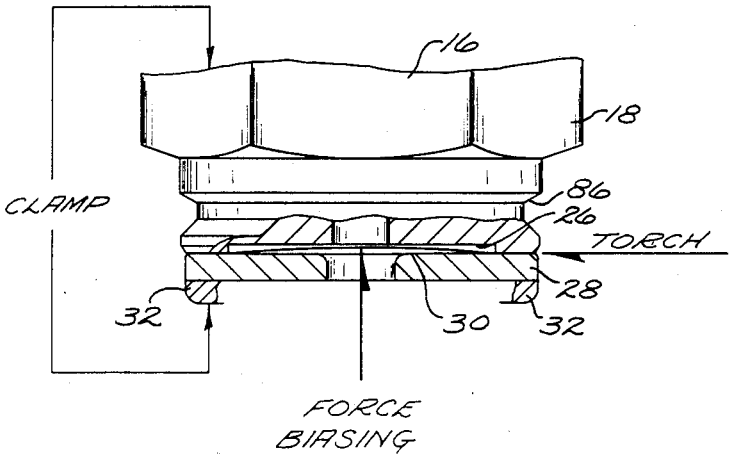
FIG. 6 is a partial view, partly in cross section of the sensor portion of the device showing details of how that portion is constructed.

In assembling the switch the support plate 28 is preferably first attached to housing 32 by conventional tungsten inert gas shielded welding as seen in FIG. 5. Then, as depicted in FIG. 6, the switch assembly 14 and fitting 16 are clamped together with membrane 30 placed therebetween, a selected biasing force is placed on the membrane by spring 36 as indicated by the arrow labeled Force Biasing, preferably approximately fourteen pounds in an upward direction forcing the membrane against wall 26 and then the outer peripheral portion of the members are welded together as indicated by the arrow labeled Torch. Preferably the welding is accomplished using a conventional tungsten inert gas shielded welding torch. In this way the membrane is formed with a slight bulge making it flexible and movable between wall 26 and support plate 28. This provides a sensor having a particularly long life since no grooves or pleats are formed in the membrane as has been done in prior art devices which thereby set up locales subject to aging and fatigue.

It should also be noted that use of the relatively massive fitting 16 and rigid support plate 28 serve to isolate the membrane from undesirable forces which could affect its sensitivity. That is, in a device such as that disclosed in U.S. Pat. No. 4,296,287 referenced above a snap acting disc is placed between a dished housing sheet and a support sheet of generally the same order of thickness and the three elements are welded together about their peripheries however the weld nugget eventually tends to introduce hoop stress which affects the disc mount and tends to affect the bulge of the disc thereby in turn affecting the calibration pressure for actuation and release and reducing its useful life. By forming wall 26 in the mass of the fitting deleterious bending forces acting on the mounted portion of the membrane are obviated. Further, matching the materials used for the fitting, support plate and membrane to achieve similar thermal expansion among the parts reduces ambient sensitivity of the device.

As noted in FIG. 2, to the right of the longitudinal axis 92 plug 60 projects out of the open end of tubular portion 38 with the reduced diameter portion 62 limiting outward movement of the plug 60. In this position a first, minimum bias is applied by spring 56 to piston 40 against the lower side of membrane 30 to provide a certain calibration pressure value. As shown in the Figure, the pressure exerted by P is greater than the force exerted by the spring so that the contacts are shown in the closed position. By moving plug 60 inwardly, coil spring 56 is compressed thereby increasing the bias of piston 40 against membrane 30 so that any selected calibration value can be obtained, as diagrammatically indicated, within the calibration range. When the selected value is reached, the side wall of tubular portion 38 is deformed inwardly as indicated by arrow 94 on the side of the device to the left of longitudinal axis 92.

It will be appreciated that the range of calibration can also be changed as by using a different strength for spring 56. Further the switch can be made into a vacuum responsive switch if desired by placing suitable springs on the opposite side of membrane 30 in fitting 16.

Use of spring 56 is particular advantageous in that not only does it facilitate precise and easy adjustment of calibration, it provides a vibration resistant device. Further, it should be noted that plug 60 could be threaded, along with tubular portion 38 to allow precise adjustment by rotation of the plug which could then be locked in its desired longitudinal location by suitable epoxy material placed on the exposed threads or in certain cases it may be desired to provide a continuously varied calibration through a computer controlled system which could effect rotation of plug 60 based on changing parameters.

The device made in accordance with the invention has little differential between actuation and release pressures, is suitable for useful product life measured in the hundreds of thousands and even in the millions of cycles without noticeable drift in calibration across a wide range of ambient temperatures of, for example, from minus 40 degrees centigrade to 125 degrees centigrade.

Figure 7:
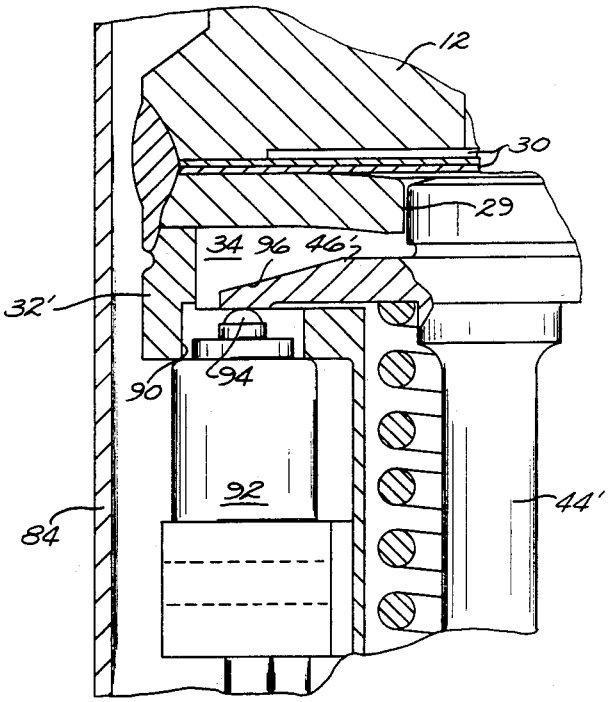
FIG. 7 is an enlarged section view of an alternate embodiment in which a miniature switch is employed.

With reference to FIG. 7 an alternative embodiment is shown in which a miniature switch is substituted in switch chamber 34 for contact bridge 68 and stationary contacts 76, 78 shown in FIGS. 1 and 2. in FIG. 7 an aperture 90 is formed in the bottom wall of housing 32' and a switch 92, such as a conventional single pole, double throw microswitch is attached to housing 32 in any convenient manner, as by epoxy so that actuating element 94 is adapted to be engaged by distal portion 96 of spring guide member 46'. Spring guide member 46' is shown formed integrally with piston 44' however it will be understood that it could be a separate member mounted in the piston as in FIGS. 1 and 2. While the use of this switch mechanism results in slightly greater differential than with the contact bridge member it is suitable for many applications and has the advantage of the enhanced life due to the improved sensor assembly.

Switches made in accordance with the invention are particularly resistant to overpressures. That is, if subjected to overpressure conditions the calibration of the switch will not be affected due to the bottoming out of spring guide member 46 or 46' against housing 32 or 32' before the membrane or the spring are affected. The switch also provides high resolution for calibration adjustment. For example in a switch made in accordance with the invention compression of spring 56 by 4 mils resulted in a change in calibration pressure of 1 psi. Further, hysteresis has been found to be very low and in fact tend to diminish with age.

It is to be noted that the invention is not limited in its application to the details of construction and arrangement of parts illustrated in the accompanying drawings since the invention is capable of other embodiments. Also it is to be understood that the phraseology or terminology employed is for the purpose of description and not of limitation.

What is claimed is:

1. A method for making a pressure responsive sensor comprising the steps of taking a metallic fitting having a centrally located bore extending therethrough and having an end defined by a periphery and with a recessed wall portion in communication with the bore, placing a metallic membrane having a periphery generally matching that of the end of the fitting on said end to cover the recessed wall portion, placing a metallic support having a periphery generally matching that of the end of the fitting and of the membrane over the membrane, the support having a bore in alignment with the bore in the fitting, subjecting the membrane to a sufficient force exerted through the bore in the support to cause the membrane to contact the recessed wall portion, and welding the fitting, membrane and support together along their respective peripheries.

* * * * *